US009101000B2

(12) United States Patent
Lin

(10) Patent No.: US 9,101,000 B2
(45) Date of Patent: Aug. 4, 2015

(54) DIMMABLE LED ILLUMINATING SYSTEM

(71) Applicants: HEP TECH CO., LTD., Taichung (TW); Ming-Feng Lin, Taichung (TV)

(72) Inventor: Ming-Feng Lin, Taichung (TW)

(73) Assignees: HEP TECH CO., LTD., Taichung (TW); Ming-Feng Lin, Taichung (TW)

( * ) Notice: Subject to any disclaimer, the term of this patent is extended or adjusted under 35 U.S.C. 154(b) by 161 days.

(21) Appl. No.: 14/165,259

(22) Filed: Jan. 27, 2014

(65) Prior Publication Data

US 2014/0217923 A1 Aug. 7, 2014

(30) Foreign Application Priority Data

Feb. 7, 2013 (TW) ..... 102104896 A

(51) Int. Cl.
*H05B 37/02* (2006.01)
*H05B 33/08* (2006.01)

(52) U.S. Cl.
CPC ..... *H05B 37/02* (2013.01); *H05B 33/0845* (2013.01); *H05B 33/0857* (2013.01)

(58) Field of Classification Search
CPC ..... H05B 37/02; H05B 33/0851; H05B 33/0845; H05B 33/0881; Y02B 20/72
USPC ..... 315/291, 294, 300, 302, 312, 247; 362/227, 249.02, 249.03
See application file for complete search history.

(56) References Cited

U.S. PATENT DOCUMENTS 8,410,726 B2 * 4/2013 Dau et al. ..... 315/312
2011/0115410 A1 * 5/2011 Kim ..... 315/297

* cited by examiner

*Primary Examiner* — Haiss Philogene
(74) *Attorney, Agent, or Firm* — Ming Chow; Sonica, LLC

(57) ABSTRACT

A dimmable LED illumination system includes a power converting circuit and a lamp. The power converting circuit is electrically connected to a power source to convert electric power of the power source into a voltage signal. The lamp includes a DC/DC converter and a LED module, wherein the DC/DC converter is electrically connected to the power converting circuit to convert the voltage signal into a corresponding current signal. The LED module is electrically connected to the DC/DC converter to be driven by the current signal to emit light. By adjusting a voltage provided by the power converting circuit, a current provided by the DC/DC converter could be adjusted as well, which changes a luminance of the LED module.

10 Claims, 2 Drawing Sheets

DIMMABLE LED ILLUMINATING SYSTEM

The current application claims a foreign priority to the patent application of Taiwan No. 102104896 filed on Feb. 7, 2013.

BACKGROUND OF THE INVENTION

1. Technical Field

The present invention relates generally to an illuminating system, and more particularly to a dimmable LED illuminating system.

2. Description of Related Art

Fluorescent lamp is the commonest device for indoor lighting. In order to provide a room with different luminance, a conventional method is to light fluorescent lamps with different numbers. It is because that the fluorescent lamps can be turned on and off only; in other words, there is no intermediate status in between. Sometimes, it provides an uneven brightness in the room when specified fluorescent lamps are off. Furthermore, only a few grades of luminance can be selected because there are only a few combinations of the specific fluorescent lamps to be on and off.

In present days, more and more fluorescent lamps are replaced by LED (light emitting diode) lamps, which have significantly better energy conversion efficiency than the fluorescent lamps. In the field of LED lamps, how to make the LED lamp provide a stable and constant luminance even while the input voltage is changing is an important issue in design of the driver of the LED lamp. Therefore, we are trying to design a LED lamp which is dimmable with a new circuit design.

BRIEF SUMMARY OF THE INVENTION

In view of the above, the primary objective of the present invention is to provide a dimmable LED illuminating system, which is able to control a luminance of the LED lamp.

The present invention provides a dimmable LED illumination system, which includes a power converting circuit and at least one lamp. The power converting circuit is electrically connected to a power source to convert an electric power of the power source into a first DC signal, wherein a voltage of the first DC signal is between a first voltage and a second voltage, and the first voltage is greater than the second voltage; The at least one lamp has a DC/DC converter and a LED module, wherein the DC/DC converter is electrically connected to the power converting circuit to convert the first DC signal of the power converting circuit into a second DC signal; a current of the second DC signal is between a first current and a second current; the current of the second DC signal is identical to the first current while the voltage of the first DC signal is identical to the first voltage, and the current of the second DC signal is identical to the second current while the voltage of the first DC signal is identical to the second voltage; and the LED module is electrically connected to the DC/DC converter to be driven by the second DC signal to emit light.

Whereby, the luminance of the LED lamp could be adjustable by controlling the voltage of the DC signals.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
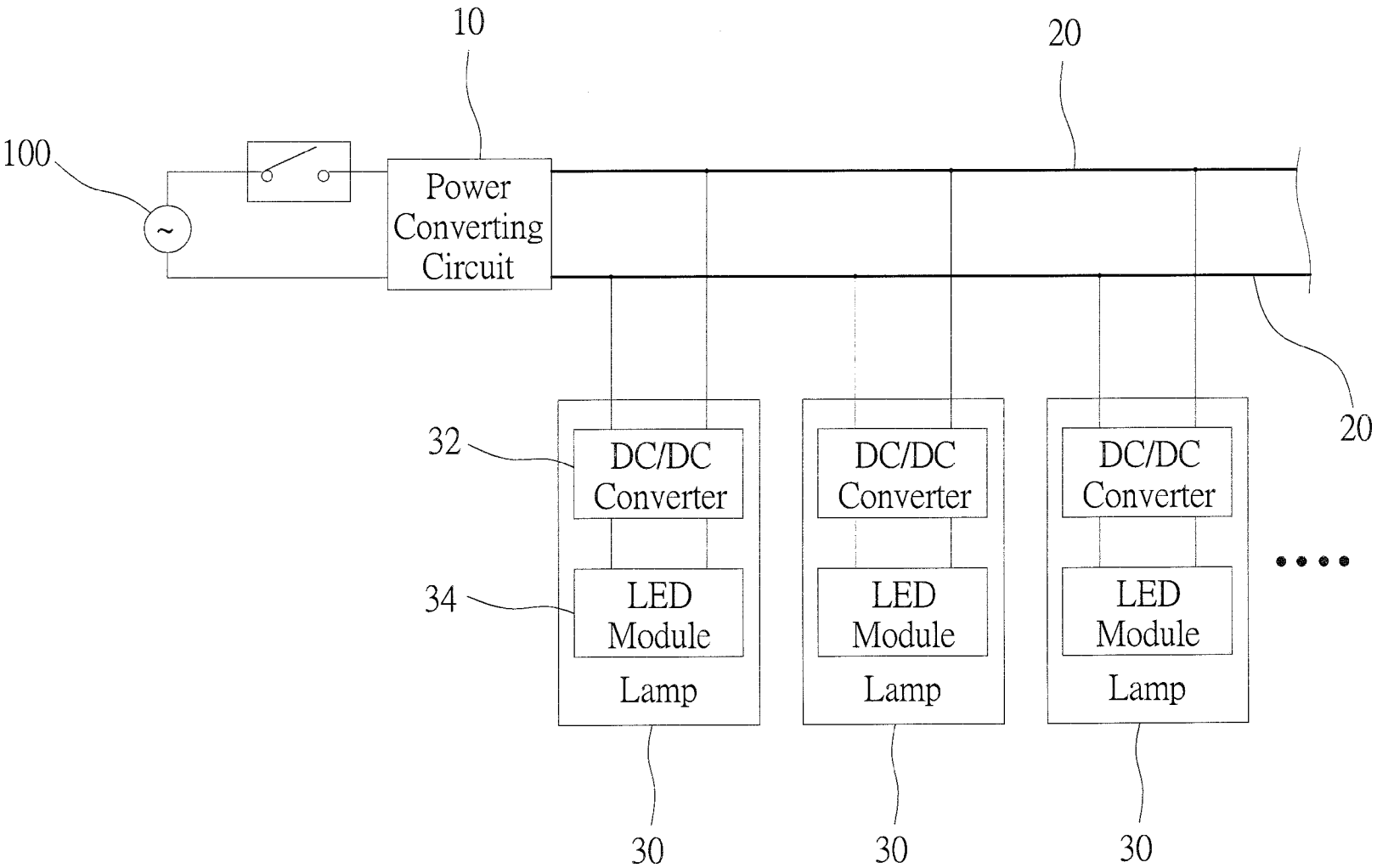
FIG. 1 is a circuit diagram of a first preferred embodiment of the present invention.

As shown in FIG. 1, a dimmable LED illuminating system of the first preferred embodiment of the present invention is a track lighting system, which includes a power converting circuit 10, two tracks 20, and a plurality of lamps 30.

The power converting circuit 10 is connected to a power source 100 to receive electric power from the power source 100, and convert it into a first DC (direct current) signal. The first DC signal has a voltage, which is between a first voltage and a second voltage. The first voltage is higher than the second voltage. In an embodiment, the power source 100 is a power network which provides 110V AC (alternate current). The voltage of AC may be between 90V and 264V in different areas. The power converting circuit 10 is designed based on a PWM (pulse width modulation) circuit to have a voltage of the first DC signal between 12V (the second voltage) and 24V (the first voltage). The power source could be a power generator, a battery, or other equivalent devices. In an embodiment, the power converting circuit 10 could be a full-wave bridge rectifier, a half-wave bridge rectifier, or other equivalent devices.

The tracks 20 are made of a conductive material, such as copper, aluminum, iron, or a conductive alloy. Lengths of the tracks 20 are about 2 meters. The tracks 20 are parallel to each other and are mounted on a wall or a roof of a building (not shown). The tracks 20 are electrically connected to the power converting circuit 10. A potential difference between the tracks 20 is identical to the voltage of the first DC signal. Except for the tracks 20, it may provide two parallel wires, bars, or other conductors.

The lamps 30 are connected to the tracks 20 in parallel. Each lamp 30 has a DC/DC converter 32 and a LED module 34. The DC/DC converter 32 is electrically connected to the power converting circuit 10 through the tracks 20 to convert a DC voltage signal into a DC current signal. In other words, the DC/DC converter 32 receives the first DC signal and converts it into a second DC signal. The second DC signal has a current, which corresponds to the voltage of the first DC signal, and the current is between a first current and a second current. In an embodiment, the current of the second DC signal is between 10 mA (the second current) and 500 mA (the first current), and the current of the second DC signal is 500 mA (the first current) while the voltage of the first DC signal is 24V (the first voltage), and the current of the second DC signal is 10 mA (the second current) while the voltage of the first DC signal is 12V (the second voltage). In other words, the current of the second DC signal is directly proportional to the voltage of the first DC signal. In an embodiment, the current of the second DC signal is any ampere no less than 0 as required.

The LED module 34 has a plurality of LEDs, all of which are electrically connected to the DC/DC converter 32. The second DC signal of the DC/DC converter 32 is transmitted to the LEDs to make them emit light. A luminance of the LED is directly proportional to current, therefore the LEDs is getting brighter as the current of the second DC signal increases, and the LEDs is getting darker as the current of the second DC signal decreases.

As a result, it may change the luminance of the lamps 30 by changing the current of the second DC signal. A programmable control unit, an external adjustable resistor, an external voltage modulation, or other equivalent devices may be incorporated in the present invention to control the voltage of the first DC signal of the power converting circuit 32, and so as to control the current of the second DC signal. As a result, the illuminating system of the present invention is dimmable in an easy way.

Figure 2:
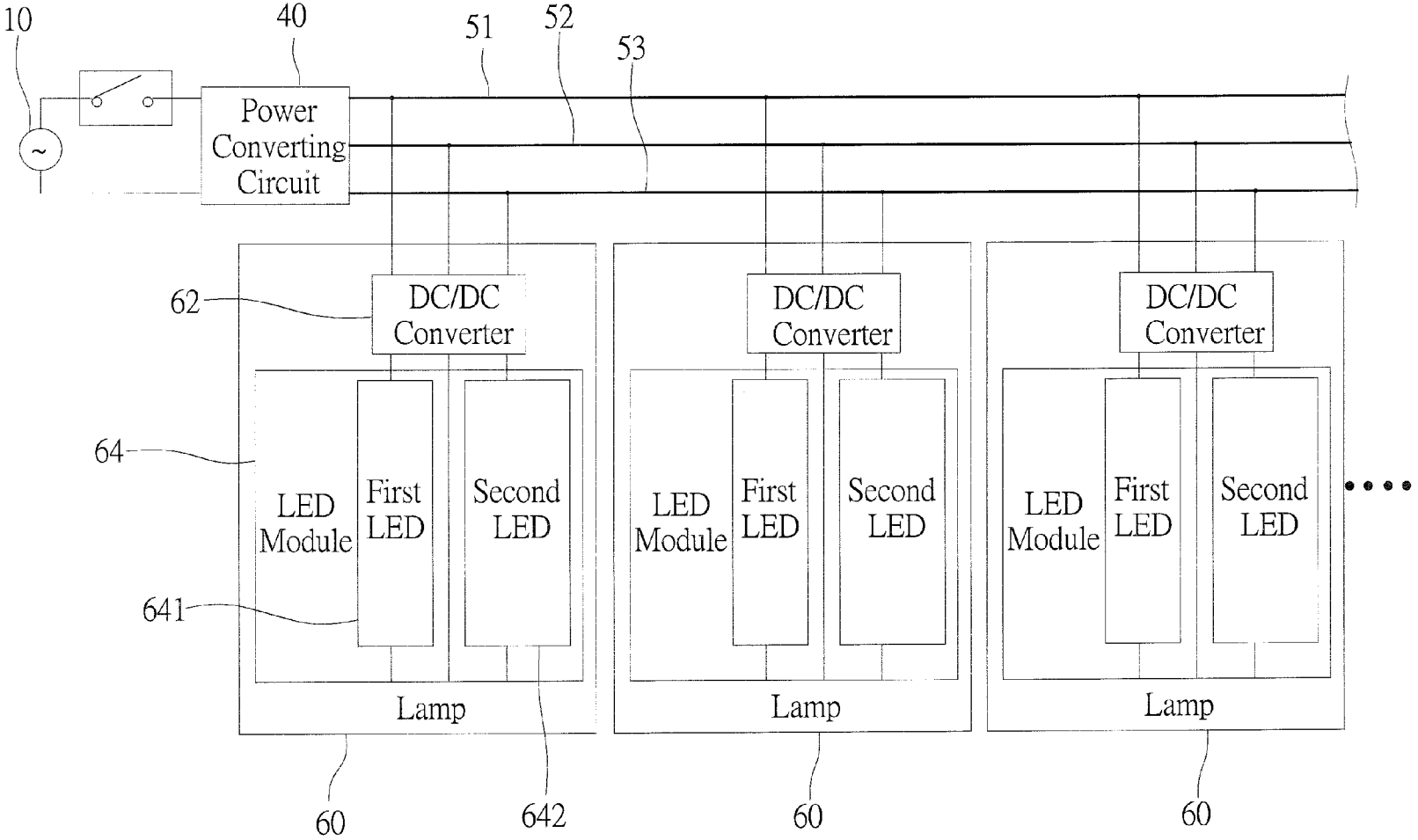
FIG. 2 is a circuit diagram of a second preferred embodiment of the present invention.

FIG. 2 shows a dimmable LED illuminating system of the second preferred embodiment of the present invention capable of changing light color, which includes a power converting circuit 40, three tracks 51, 52, 53, and a plurality of lamps 60.

The power converting circuit 40 basically is the same as the first preferred embodiment, except that the power converting circuit 40 further outputs a third DC signal, and a voltage of the third DC signal is between the first voltage (24V) and the second voltage (24V).

The tracks 51-53 includes a first track 51, a second track 52, and a third track 53, which are made of a conductive material, such as copper, aluminum, iron, or a conductive alloy. The tracks 51-53 are parallel to each other, and mounted on a roof or a wall of a building (not shown). The tracks 51-53 are electrically connected to the power converting circuit 40 respectively. The voltage of the first DC signal is identical to a potential difference between the first track 51 and the second track 52, and the voltage of the third DC signal is identical to a potential difference between the third track 53 and the second track 52. The same as above, the tracks may be replaced by parallel wires, bars, or other conductors.

The lamps 60 are provided on the tracks 51-53 respectively, and are electrically connected to each other in parallel. Each lamp 60 has a DC/DC converter 62 and a LED module 64. The DC/DC converter 62 is electrically connected to the power converting circuit 40 through the tracks 51-53 to convert the first DC signal into a second DC signal, and convert the third DC signal into a fourth DC signal. A current of the second DC signal is directly proportional to a voltage of the first DC signal, and a current of the fourth DC signal is directly proportional to a voltage of the third DC signal. The currents of the second and the fourth DC signals are between a first current (500 mA) and a second current (10 mA). The same as above, the currents of the second and the fourth DC signals could be any ampere no less than 0 as required in other embodiments.

The LED module 64 has a plurality of first LEDs 641 and a plurality of second LEDs 642. A light color of the first LEDs 641 is different from the second LEDs 642. For example, the light color of the first LEDs 641 is cold color, such as white or blue, and the light color of the second LEDs 642 is warm color, such as yellow or red. The first LEDs 641 are driven by the second DC signal, and the second LEDs 642 are driven by the fourth DC signal.

Therefore, except for changing the luminance, the dimmable LED illuminating system of the present invention also may change the light color thereof by adjusting the voltages of the first and the third DC signals respectively.

It is noted that the dimmable LED illuminating system of the present invention may be applied to a desk lamp, streetlamp, and other illuminating device. It must be pointed out that the embodiments described above are only some preferred embodiments of the present invention. All equivalent structures and methods which employ the concepts disclosed in this specification and the appended claims should fall within the scope of the present invention.

What is claimed is:

1. A dimmable LED illumination system, comprising:

a power converting circuit electrically connected to a power source to convert electric power of the power source into a first DC signal, wherein a voltage of the first DC signal is between a first voltage and a second voltage, and the first voltage is greater than the second voltage; and at least one lamp having a DC/DC converter and a LED module, wherein the DC/DC converter is electrically connected to the power converting circuit to convert the first DC signal of the power converting circuit into a second DC signal; a current of the second DC signal is between a first current and a second current; the current of the second DC signal is identical to the first current while the voltage of the first DC signal is identical to the first voltage, and the current of the second DC signal is identical to the second current while the voltage of the first DC signal is identical to the second voltage; and the LED module is electrically connected to the DC/DC converter to be driven by the second DC signal to emit light.

2. The dimmable LED illumination system of claim 1, wherein the first current is greater than the second current, and the current of the second DC signal is directly proportional to the voltage of the first DC signal.

3. The dimmable LED illumination system of claim 2, wherein the second current is no less than zero.

4. The dimmable LED illumination system of claim 1, further comprising two parallel tracks, which are made of a conductive material, electrically connected to the power converting circuit, wherein the lamp is provided on the tracks; the DC/DC converter is electrically connected to the power converting circuit through the tracks; a potential difference between the tracks is identical to the voltage of the first DC signal.

5. The dimmable LED illumination system of claim 1, wherein the power converting circuit further outputs a third DC signal; a voltage of the third DC signal is between the first voltage and the second voltage; the DC/DC converter converts the third DC signal into a fourth DC signal, which corresponds to the third DC signal; a current of the fourth DC signal is between the first current and the second current; the LED module has a plurality of first LEDs and a plurality of second LEDs; a light color of the first LEDs is different from that of the second LEDs; the first LEDs are driven by the second DC signal to emit light, and the second LEDs are driven by the fourth DC signal to emit light.

6. The dimmable LED illumination system of claim 5, further comprising a first track, a second track, and a third track, wherein the tracks are parallel to each other, and are made of a conductive material; the tracks are electrically connected to the power converting circuit, and the lamp is provided on the tracks; the DC/DC converter is electrically connected to the power converting circuit through the tracks; the voltage of the first DC signal is identical to a potential difference between the first track and the second track, and the voltage of the third DC signal is identical to a potential difference between the third track and the second track.

7. The dimmable LED illumination system of claim 5, wherein the first current is greater than the second current; the current of the second DC signal is directly proportional to the voltage of the first DC signal, and the current of the fourth DC signal is positive proportional to the voltage of the third DC signal.

8. The dimmable LED illumination system of claim 7, wherein the second current is no less than zero.

9. The dimmable LED illumination system of claim 1, wherein numbers of the at least one lamp is more than one, and the lamps are electrically connected together in parallel.

10. The dimmable LED illumination system of claim 5, wherein numbers of the at least one lamp is more than one, and the lamps are electrically connected together in parallel.

* * * * *